US009771835B2

(12) United States Patent
Adachi et al.

(10) Patent No.: US 9,771,835 B2
(45) Date of Patent: Sep. 26, 2017

(54) FLOW RATE CONTROL OF HEAT ENERGY RECOVERY DEVICE INCLUDING OIL SEPARATOR

(71) Applicant: Kobe Steel, Ltd., Kobe-shi (JP)

(72) Inventors: Shigeto Adachi, Takasago (JP); Yutaka Narukawa, Takasago (JP); Noboru Tsuboi, Kako-gun (JP); Koichiro Hashimoto, Takasago (JP); Haruyuki Matsuda, Kobe (JP); Kazumasa Nishimura, Takasago (JP); Tetsuya Kakiuchi, Takasago (JP); Kazunori Fukuhara, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 265 days.

(21) Appl. No.: 14/669,148

(22) Filed: Mar. 26, 2015

(65) Prior Publication Data

US 2015/0337690 A1 Nov. 26, 2015

(30) Foreign Application Priority Data

May 22, 2014 (JP) ..... 2014-106372

(51) Int. Cl.
*F01K 13/02* (2006.01)
*F01K 25/08* (2006.01)
(Continued)

(52) U.S. Cl.
CPC ..... *F01K 13/02* (2013.01); *F01K 7/16* (2013.01); *F01K 23/065* (2013.01); *F01K 25/08* (2013.01)

(58) Field of Classification Search
CPC ..... F01K 13/00; F01K 13/02; F01K 25/00–25/14
(Continued)

(56) References Cited

U.S. PATENT DOCUMENTS 4,526,006 A * 7/1985 Anthony ..... F01K 25/08 122/33
4,564,084 A * 1/1986 Heckel ..... F01M 5/00 184/6.11
(Continued)

FOREIGN PATENT DOCUMENTS

CN 103670549 A 3/2014
JP 09088503 A * 3/1997
(Continued)

*Primary Examiner* — Laert Dounis
(74) *Attorney, Agent, or Firm* — Oblon, McClelland, Maier & Neustadt, L.L.P.

(57) ABSTRACT

A heat energy recovery device 1, which recovers heat energy of a heat medium by utilizing a Rankine cycle of a working medium, comprises a first heater 2, a second heater 3, an expander 4, an oil separation unit 12, a condenser 6, a working medium pump 7, and an oil-leading passage 10. When the height of a liquid level in the oil separation unit 12 is less than a lower limit value, a control unit 16 first performs a speed reduction control of the working medium pump 7 to reduce an inflow rate of a working medium into the second heater 3, and after a fixed period of time, performs an opening control for opening an on-off unit 11. By the opening of the on-off valve 11, oil L1 in the second heater 3 is led out to the oil separation unit 12 through the oil-leading passage 10.

11 Claims, 12 Drawing Sheets

(51) Int. Cl.
*F01K 7/16* (2006.01)
*F01K 23/06* (2006.01)

(58) Field of Classification Search
USPC ..... 60/657, 651, 671
See application file for complete search history.

(56) References Cited

U.S. PATENT DOCUMENTS

2004/0250546 A1* 12/2004 Ichikawa ..... F01C 11/008 60/670
2012/0151926 A1* 6/2012 Labbe ..... F01K 7/40 60/670
2012/0312021 A1* 12/2012 Tsuboi ..... F01K 13/02 60/667
2015/0218972 A1* 8/2015 Ono ..... F01K 23/04 60/719
2015/0275699 A1* 10/2015 Waibel ..... F01K 7/165 60/615

FOREIGN PATENT DOCUMENTS

JP 2014-047636 3/2014
JP 2014047636 A * 3/2014
JP 2014062542 A * 4/2014

* cited by examiner

FLOW RATE CONTROL OF HEAT ENERGY RECOVERY DEVICE INCLUDING OIL SEPARATOR

BACKGROUND OF THE INVENTION

Field of the Invention

The present invention relates to a heat energy recovery device for recovering exhaust heat.

Description of the Related Art

As a device for recovering heat energy from geothermal water and the like, a heat energy recovery device has been conventionally known, and a binary generator is a typical example of such device.

An example of the binary generator includes a power generator described in JP 2014-047636 A (hereinafter referred to as Patent Document 1). The power generator comprises a circulation flow passage where an evaporator, a super heater, an expander, an oil separation unit, a condenser, and a pump are sequentially connected in this order to form a closed circuit. Between the super heater and the oil separation unit, a bypass channel is provided for leading lubricant accumulated in the super heater to the oil separation unit, and the bypass channel includes a bypass valve. A temperature sensor for detecting the temperature of a working medium is provided both on the upstream and downstream sides of the super heater in the circulation flow passage. Further provided is a control means that calculates a heat exchange quantity in the super heater based on the difference in detection values of both temperature sensors (temperature difference), and opens the bypass valve at a point of time when the heat exchange quantity falls below a threshold.

In this power generator, the bypass valve is configured to open at a point of time when the heat exchange quantity in the super heater falls below the threshold, thus the lubricant in the super heater can be removed through the bypass valve. Having such configuration can suppress a decrease in efficiency of heat exchange in the super heater caused by the lubricant accumulated in the super heater.

However, in the power generator of Patent Document 1, the bypass valve is controlled based on the heat exchange quantity calculated from the detection values of the temperature sensors, thus the bypass valve is not always opened when the lubricant is accumulated in the super heater.

Further, if a heat quantity of a heat medium supplied to the evaporator and the super heater is insufficient or a circulation rate of a working medium is increased, the working medium in a liquid-phase and oil sometimes form a liquid layer in the super heater. When the lubricant is recovered by the method disclosed in Patent Document 1 in a binary generator that uses lubricant having a smaller specific gravity than the working medium, since a layer of the working medium in a liquid-phase is formed under a layer of the lubricant, the working medium layer is preferentially recovered to the oil separation unit, thus the amount of the working medium, which does not contribute to power generation, increases. As the result, the efficiency of power generation is decreased.

An object of the present invention is to provide a heat energy recovery device capable of properly operating under an environment in which a heat input quantity of a heat medium and a circulation rate of a working medium fluctuate.

SUMMARY OF THE INVENTION

As a means for solving the above problem, the present invention provides a heat energy recovery device that includes a working medium and oil having a smaller specific gravity than the working medium, coexisting with the working medium, and utilizes a Rankine cycle of the working medium. The heat energy recovery device comprises a first heater for heating a working medium by heat exchange with a heating medium, a second heater for further heating the working medium flowing out of the first heater by heat exchange with a heating medium, an expander driven by the working medium flowing out of the second heater, a motive energy recovery unit connected to the expander, a condenser for condensing the working medium flowing out of the expander, a working medium pump for sending the working medium condensed in the condenser to the first heater, an oil separation unit for separating oil from the working medium, an oil-leading passage for leading oil in the second heater to the oil separation unit, connected to the upstream side of the second heater or a heater connection pipe connecting the second heater and the first heater, through which a working medium flows, an on-off unit disposed in the oil-leading passage, and a control unit for controlling an inflow rate of a working medium into the second heater, and opening-closing of the on-off unit. The control unit performs a flow rate reduction control for reducing a flow rate of a working medium heading to the second heater, and an opening control for opening the on-off unit, thereby leading out oil accumulated in the second heater to the oil separation unit through the oil-leading passage.

In the heat energy recovery device of the present invention, it is made possible to lead out substantially only oil accumulated in the second heater to the oil separation unit through the oil-leading passage connected to the upstream side of the second heater or the heater connection pipe under an environment in which a heat input quantity of a heat medium and a circulation rate of a working medium fluctuate in the second heater. As the result, a decrease in the efficiency of power generation can be suppressed and the heat energy recovery device can operate properly.

In the present invention, the flow rate reduction control and the opening control are preferably performed when the working medium in a liquid-phase and the oil form an accumulation layer in the second heater.

Having such configuration prevents that a larger amount of the working medium in a liquid-phase is led out along with the oil to the oil separation unit.

Further, in the present invention, the flow rate reduction control preferably reduces a rotational speed of the working medium pump.

Having such configuration makes it easy to control an inflow rate of a working medium into the second heater.

Further, in the present invention, the control unit preferably waits for a fixed period of time after performing the flow rate reduction control, and then performs the opening control.

Having such configuration simplifies a constitution of the heat energy recovery device as well as control operations of the control unit.

Further, in the present invention, it is preferable that a liquid level sensor for detecting the height of a liquid level of the oil or the height of a liquid level of its equivalent in the second heater is provided, and the control unit, after performing the flow rate reduction control, performs the opening control when the height of the liquid level of the oil or the height of the liquid level of its equivalent reaches a predetermined value.

Such configuration can surely prevent the leakage of the working medium to the oil separation unit.

Further, in the present invention, it is preferable that the oil-leading passage is connected to the heater connection pipe, and the control unit first performs the flow rate reduction control to move oil in the second heater to the heater connection pipe and then performs a control for increasing a flow rate of a working medium while performing the opening control.

Having such configuration makes it possible to properly lead out the oil to the oil separation unit through the oil-leading passage even if the second heater has a structure by which a liquid level sensor and the like are difficult to be installed inside of the second heater.

Further the present invention provides a heat energy recovery device that includes a working medium and oil having a smaller specific gravity than the working medium, coexisting with the working medium, and utilizes a Rankine cycle of the working medium. The heat energy recovery device comprises a first heater for heating a working medium by heat exchange with a heating medium, a second heater for further heating the working medium flowing out of the first heater by heat exchange with a heating medium, an expander driven by the working medium flowing out of the second heater, a motive energy recovery unit connected to the expander, a condenser for condensing the working medium flowing out of the expander, an oil separation unit for separating oil from the working medium, an oil-leading passage including a plurality of channels having different heights from one another, which are connected to the second heater, a plurality of on-off units disposed in the plurality of channels, and a control unit for controlling opening-closing of each of the plurality of on-off units. The control unit sequentially opens the on-off units disposed in the plurality of channels in order from the one disposed in the channel having the highest connection position with the second heater, thereby leading out oil to the oil separation unit through the oil-leading passage.

In the heat energy recovery device of the present invention, oil in the second heater can be easily led out to the oil separation unit without controlling a rotational speed of a working medium pump.

In the heat energy recovery device of the present invention, the control unit preferably opens the on-off units disposed in the plurality of channels from the one disposed in the channel having the highest connection position with the second heater, when a working medium in a liquid-phase and oil form an accumulation layer in the second heater.

Having such configuration prevents that a larger amount of the working medium in a liquid-phase is led out along with the oil to the oil separation unit.

Further the present invention provides a heat energy recovery device that includes a working medium and oil having a smaller specific gravity than the working medium, coexisting with the working medium, and utilizes a Rankine cycle of the working medium. The heat energy recovery device comprises a first heater for heating a working medium by heat exchange with a heating medium, a second heater for further heating the working medium flowing out of the first heater by heat exchange with a heating medium, an expander driven by the working medium flowing out of the second heater, a motive energy recovery unit connected to the expander, a condenser for condensing the working medium flowing out of the expander, a working medium pump for sending the working medium condensed in the condenser to the first heater, an oil separation unit for separating oil from the working medium, an oil-leading passage for leading oil in the second heater to the oil separation unit, connected to the downstream side of the second heater or a channel connecting the second heater and the expander, an on-off unit disposed in the oil-leading passage, and a control unit for controlling an inflow rate of a working medium into the second heater and opening-closing of the on-off unit. The control unit performs a flow rate-increasing control for increasing a flow rate of a working medium heading to the second heater, and an opening control for opening the on-off unit, thereby leading out oil to the oil separation unit through the oil-leading passage.

In the heat energy recovery device of the present invention, the amount of a working medium in a liquid-phase is intentionally increased in the second heater, so that only an oil layer formed on the top of the working medium in a liquid-phase can be led out to the oil separation unit through the oil-leading passage.

In the present invention, the flow rate-increasing control and the opening control are preferably performed when a working medium in a liquid-phase and oil form an accumulation layer in the second heater.

Having such configuration prevents that a larger amount of the working medium in a liquid-phase is led out along with the oil to the oil separation unit.

Further, in the present invention, the flow rate-increasing control is preferably a control for increasing a rotational speed of the working medium pump.

In such configuration, an inflow rate of the working medium into the second heater can be easily controlled.

As described above, according to the present invention, it is possible to provide a heat energy recovery device capable of properly operating under an environment in which a heat input quantity of a heat medium and a circulation rate of a working medium fluctuate.

DESCRIPTION OF THE PREFERRED EMBODIMENTS

Hereinafter, the preferred embodiments of the present invention will be described in detail with reference to the attached drawings.

(First Embodiment)

Figure 1:
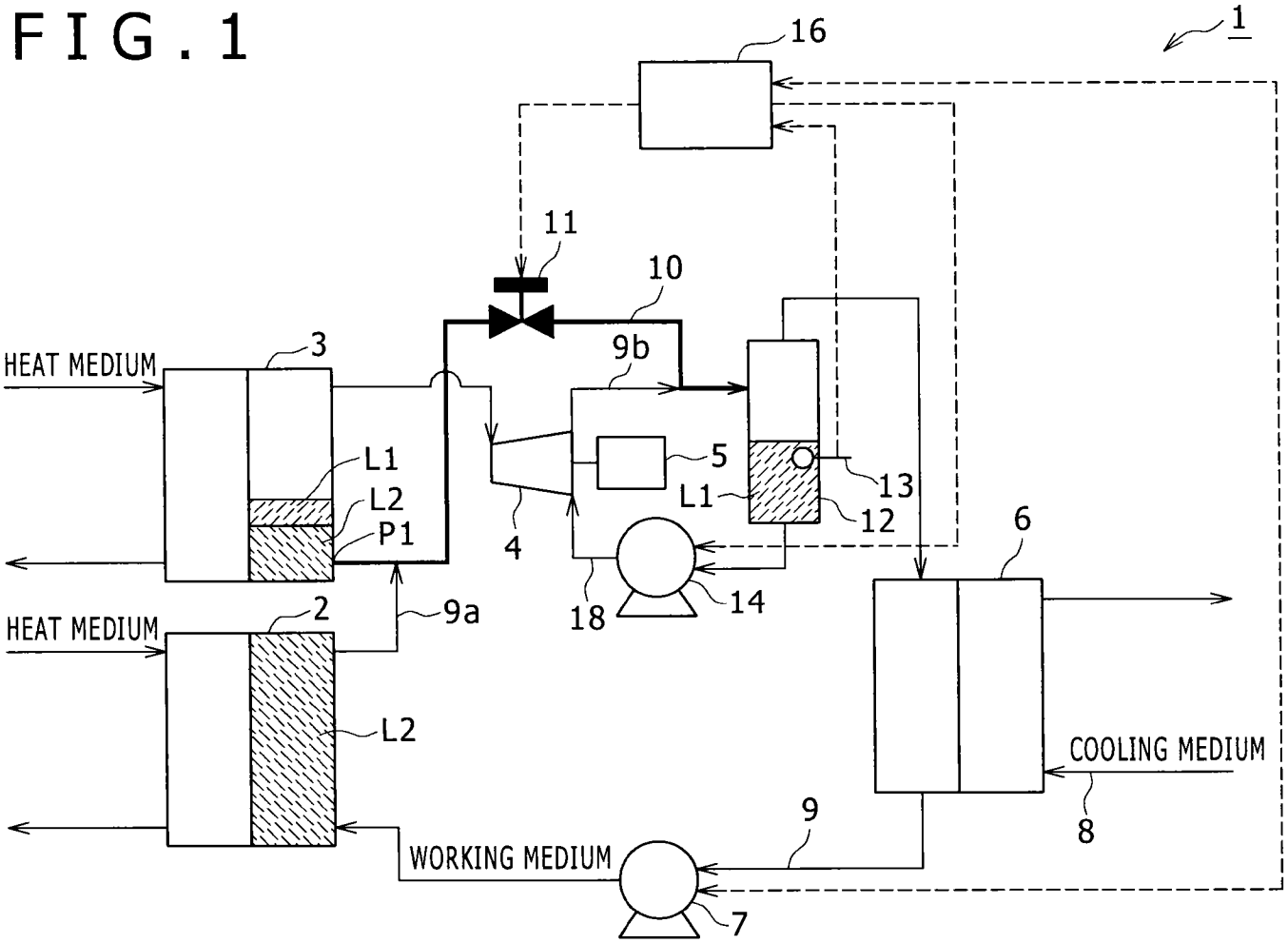
FIG. 1 is a configuration diagram showing a heat energy recovery device according to a first embodiment of the present invention.

FIG. 1 is a configuration diagram showing a heat energy recovery device 1 according to a first embodiment of the present invention. In FIG. 1, solid arrows indicate a flow of various media, while dotted arrows indicate a flow of electric signals.

A heat energy recovery device 1 is a device for recovering heat energy of a heat medium by utilizing a Rankine cycle of a working medium, and comprises a first heater 2, a second heater 3, an expander 4, an oil separation unit 12, a condenser 6, a working medium pump 7, a circulation flow passage 9, an oil-leading passage 10, and a control unit 16. In the circulation flow passage 9, the first heater 2, the second heater 3, the expander 4, the oil separation unit 12, the condenser 6, and the working medium pump 7 are connected in series in this order to circulate a working medium. As the working medium, a low boiling point organic medium having a boiling point lower than that of water, such as R245fa, is used. In FIG. 1, the working medium in a liquid-phase present in the condenser 6 is not shown. The working medium coexists with oil, thus the oil is circulating in the circulation flow passage 9 along with the working medium. The oil is used for lubricating various members of the expander 4 and other purposes. The oil has a smaller specific gravity than the working medium.

The first heater 2 comprises a channel through which a working medium circulates and a channel through which a heat medium circulates. As the first heater 2, a shell-and-tube heat exchanger is used. As the heat medium, for example, exhaust gas discharged from an internal combustion engine in a ship, etc., compressed air discharged from a supercharger and a compressor, and the like are used. Examples of the heat medium further include geothermal water, high-temperature steam generated from the geothermal water, and the like, however the heat medium is not particularly limited thereto.

The first heater 2 functions as an evaporator in which the working medium flowing into the first heater 2 is evaporated by heat exchange with the heat medium. However, the first heater 2 may also function as a preheater for increasing the temperature of the working medium in a liquid-phase, if a heat input quantity from the heat medium decreases or a circulation rate of the working medium increases. Whether the first heater 2 functions as the evaporator or the preheater is determined, for example, based on a liquid level in a reservoir not illustrated that is disposed on the downstream side of the condenser 6 to store the working medium in a liquid-phase. In the first heater 2, the oil coexisting with the working medium is discharged along with the working medium.

The second heater 3 comprises a channel through which the working medium circulates and a channel through which the heat medium circulates, and is arranged on the downstream side of the first heater 2 in the circulation flow passage 9. As the second heater 3, a shell-and-tube heat exchanger is used. The second heater 3 functions as a super heater, in which the working medium flowing out of the first heater 2 is over heated by heat exchange with the heat medium. However, when the first heater 2 functions as the preheater, the second heater 3 functions as the evaporator to evaporate the working medium in a liquid-phase flowing into the second heater 3, and the oil and the working medium in a liquid-phase form a liquid layer (hereinafter referred to as an "accumulation layer") in the second heater 3. Since the oil has a smaller specific gravity than the working medium in a liquid-phase, the upper part of the accumulation layer is occupied by a layer of oil L1. In general, oil hardly flows along with a working medium in a vapor-phase, thus even when the second heater 3 functions as the super heater, the oil L1 is easily accumulated in the second heater 3.

The expander 4 is a screw expander and arranged on the downstream side of the second heater 3 in the circulation flow passage 9. As the expander 4, a scroll-type and a turbo-type expanders may be used. In the expander 4, the working medium in a vapor-phase flowing out of the second heater 3 is expanded to drive a rotor. A drive shaft of the expander 4 is connected to a power generator 5, which is a motive energy recovery unit, thus a rotation of the rotor in the expander 4 can drive power generator 5 to generate power.

The condenser 6 comprises a channel through which a cooling medium circulates and a channel through which the working medium circulates, and condenses the working medium flowing out of the expander 4 by heat exchange with the cooling medium. The cooling medium is sent to the condenser 6 by a cooling medium pump (not illustrated) disposed in a cooling medium passage 8 and takes heat from the working medium in the condenser 6.

As the working medium pump 7, a centrifugal pump, a gear pump, and the like are used. The working medium pump 7 is arranged between the condenser 6 and the first heater 2 in the circulation flow passage 9 and sends the working medium in a liquid-phase condensed in the condenser 6 to the first heater 2.

The oil separation unit 12 is arranged between the expander 4 and the condenser 6 in the circulation flow passage 9. The oil separation unit 12 separates the oil from the working medium discharged from the expander 4 and stores it. The oil separation unit 12 is connected to an oil passage 18. The oil passage 18 is in turn connected to the expander 4. By the operation of an oil pump 14 disposed in the oil passage 18, the oil stored in the oil separation unit 12 is sent to an expansion chamber, a bearing, and the like in the expander 4 through the oil passage 18.

The oil separation unit 12 is provided with a liquid level sensor 13 for detecting the height of a liquid level of the oil in the separation unit 12. As the liquid level sensor 13, for example, a float switch is used. Providing the liquid level sensor 13 makes it possible to detect an increase/decrease of the oil level in the oil separation unit 12. The liquid level sensor 13 outputs signals according to detection results to a control unit 16. In the heat energy recovery device 1, the amount of the oil in the separation unit 12 decreases as the amount of the oil L1 accumulating in the second heater 3 increases.

The oil-leading passage 10 is connected to a pipe 9*b* in the circulation flow passage 9, connecting the expander 4 and the oil separation unit 12, and a pipe in the circulation flow passage 9, connecting the first heater 2 and the second heater 3 (hereinafter referred to as a "heater connection pipe 9*a*"). A downstream side end P1 of the heater connection pipe 9*a* is connected to a lower part, i.e. the upstream side, of the second heater 3. Providing the oil-leading passage 10 makes it possible to lead out the oil in the second heater 3 to the oil separation unit 12. The oil-leading passage 10 is provided with an on-off valve 11, which is a solenoid valve, functioning as an on-off unit. The on-off valve 11 is controlled by the control unit 16.

The control unit 16 controls a rotational speed of the working medium pump 7 and opening-closing of the on-off valve 11.

As described above, during the operation of the heat energy recovery device 1, the accumulation layer is sometimes formed in the second heater 3 if the heat input quantity of the heat medium decreases, the circulation rate of the working medium increases, or by other reasons. Below, a sequence of steps by which the oil is led out from the second heater 3 to the oil separation unit 12 during the operation of the heat energy recovery device 1 will be described with reference to FIG. 2.

First, the control unit 16 determines whether or not the height of a liquid level in the oil separation unit 12 falls below a predetermined lower limit value, i.e. whether or not a storage amount of the oil in the oil separation unit 12 is decreased (step S1). The lower limit value is set in advance by a test and a simulation. In the description below, the liquid level of the oil in the oil separation unit 12 is refereed to as an "in-separation unit liquid level". When it is determined that the height of the in-separation unit liquid level is the lower limit value or more (determined as NO), then the step S1 is repeated. On the other hand, when it is determined that the height of the in-separation unit liquid level is less than the lower limit value (determined as YES), then the control unit 16 performs a control to reduce the rotational speed of the working medium pump 7 (hereinafter referred to as a "speed reduction control").

The speed reduction control reduces the amount of the working medium in a liquid-phase flowing into the second heater 3 (step S2). While the speed reduction control is maintained for a fixed period of time (step S3), the amount of the working medium in a liquid-phase L2 is reduced, thus the accumulation layer becomes small in the second heater 3, and finally substantially only an oil L1 layer is remained. In practice, since the heat medium is supplied to the second heater 3, evaporation of the working medium in a liquid-phase also contributes to the reduction of the accumulation layer. The fixed period of time described above is appropriately determined based on a test and a simulation.

After waiting for the fixed period of time, the control unit 16 performs an opening control for opening an on-off valve 11 (step S4). When the on-off valve 11 is opened, a pressure difference between the second heater 3 and the oil separation unit 12 is generated, so that the oil L1 in the second heater 3 is led out to the oil separation unit 12 through the oil-leading passage 10.

Then, after the lapse of a predetermined period of time, the control unit 16 determines whether or not the height of the in-separation unit liquid level reaches the lower limit value or more (step S5). The predetermined period of time in this step may be set based on a test and a simulation, or calculated based on a flow rate of the oil circulating inside the oil-leading passage 10 (in practice, a small amount of the working medium is contained). When it is determined that the height of the in-separation unit liquid level is less than the lower limit value, the on-off valve 11 is kept open further for the predetermined period of time and the height of the in-separation unit liquid level is detected again.

When it is determined that the height of the in-separation unit liquid level reaches the lower limit value or more, the control unit 16 performs a closing control for closing the on-off valve 11 (step S6), and the rotational speed of the working medium pump 7 is restored to the original rotational speed before the speed reduction control. As the result, the inflow rate of the working medium into the second heater 3 is restored to the original setting (step S7). During the operation of the heat energy recovery device 1, when the storage amount of the oil in the oil separation unit 12 is decreased again, the above-mentioned steps S2-S7 are repeated.

As described above, in the heat energy recovery device 1 according to the present embodiment, when the accumulation layer is formed in the second heater 3, the speed reduction control of the working medium pump 7 (i.e. a control for reducing a flow rate of the working medium heading to the second heater 3) is performed, and also the on-off valve 11 in the oil-leading passage 10 is opened. These operations make it possible to lead out substantially only the oil L1 from the second heater 3. The operations can suppress that a larger amount of the working medium in a liquid-phase in the second heater is discharged into the oil separation unit 12, thus preventing a decrease in the efficiency of power generation caused by the increasing amount of the working medium, which does not contribute to drive the expander 4. Moreover, performing such operations can prevent a reduction of a heat transferring area between the heat medium and the working medium caused by the oil L1 layer present in the second heater 3, thus further preventing a decrease in the efficiency of power generation. As the result, the heat energy recovery device 1 can properly operate under an environment in which a heat input quantity from a heat medium and a circulation rate of a working medium fluctuate.

Even if a shell-and-tube heat exchanger is used as the second heater 3, in which case the oil tends to accumulate inside of the heater instead of being flown out along with the working medium, the oil can be properly discharged from the second heater 3.

In the heat energy recovery device 1, after the speed reduction control of the working medium pump is performed, the fixed period of time is waited in order to open the on-off valve 11, thus this opening control can simplify a constitution of the heat energy recovery device 1 as well as control operations of the control unit 16, as compared with the case of controlling opening-closing of the on-off valve 11 based on the height of a liquid level of the accumulation layer.

(Variation of First Embodiment)

In the first embodiment, in place of the liquid level sensor 13 provided inside of the oil separation unit 12, a pressure sensor for detecting a discharge pressure of the oil pump 14 may be installed. Detection results of the pressure sensor are sent to the control unit 16.

Figure 2:
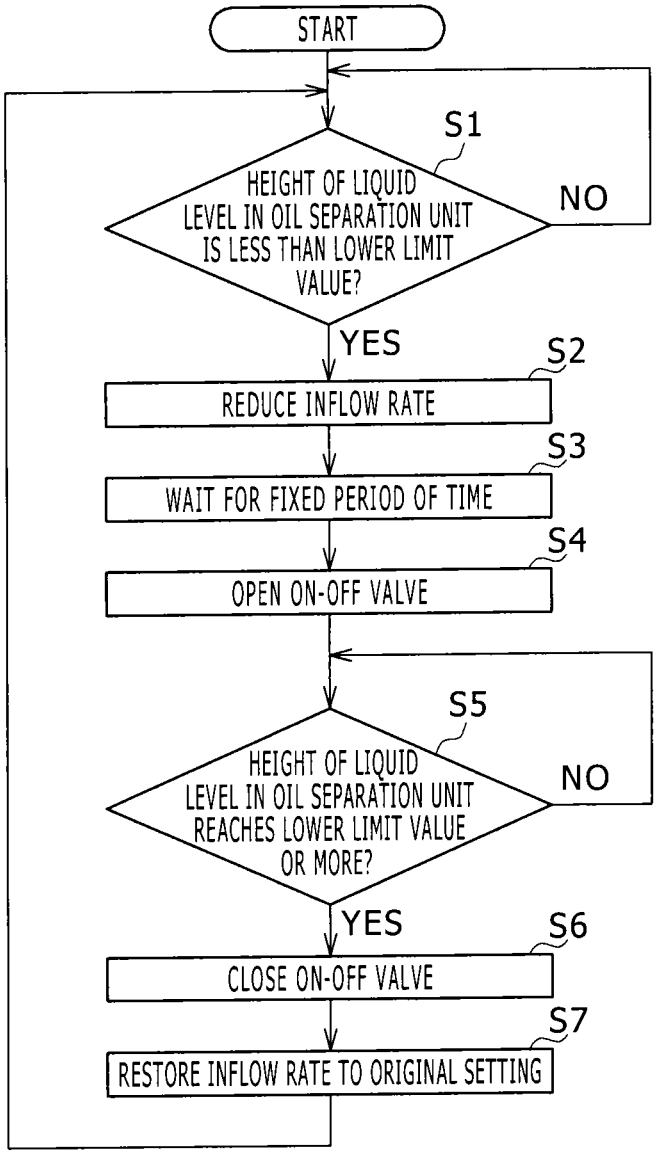
FIG. 2 is a flowchart showing operations of a control unit of the heat energy recovery device.

The control unit 16 determines whether or not the discharge pressure is less than a predetermined value in the step S1 of FIG. 2, and determines whether or not the discharge pressure reaches the predetermined value or more in the step S5. The predetermined value is, for example, set to a discharge pressure under which cavitation occurs in the oil pump 14 due to a reduced amount of the oil in the oil separation unit 12. Thus using a pressure sensor can also detect an increase/decrease of the amount of the oil in the oil separation unit 12. In the variation of the first embodiment, the same effect can be exerted as in the first embodiment.

(Second Embodiment)

Figure 3:
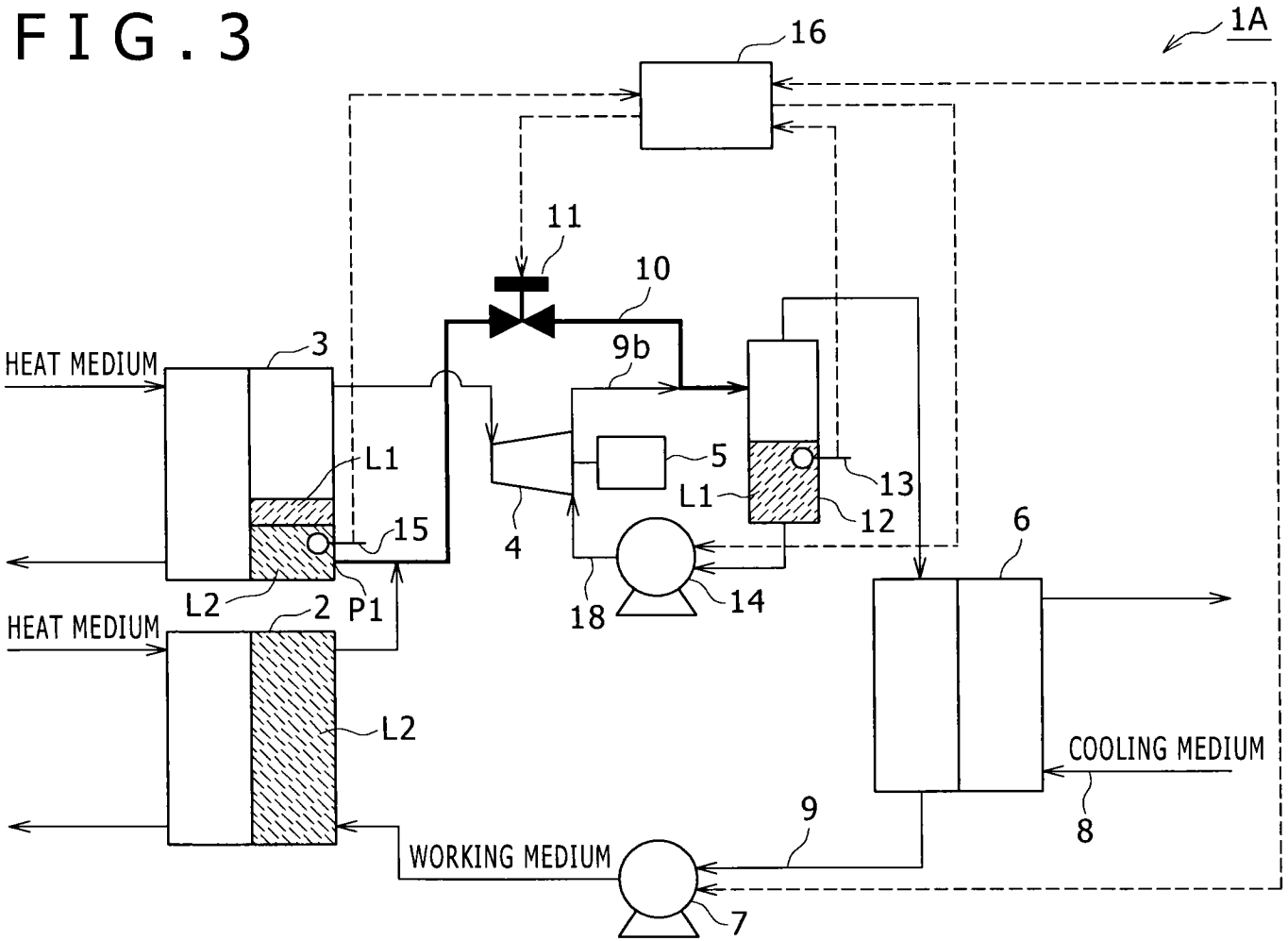
FIG. 3 is a configuration diagram showing a heat energy recovery device according to a second embodiment of the present invention.

FIG. 3 is a configuration diagram showing a heat energy recovery device 1A according to a second embodiment of the present invention. Only constitution elements different from the first embodiment will be described here and the description of other constitution elements is omitted.

Figure 4:
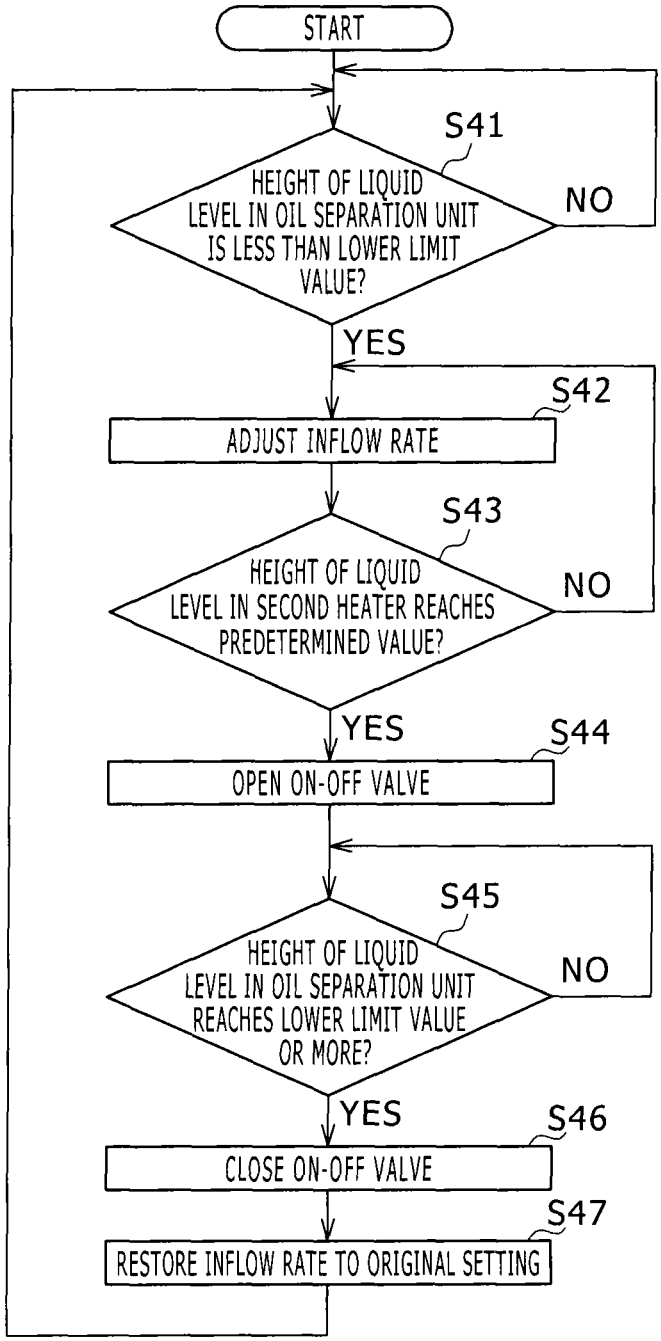
FIG. 4 is a flowchart showing operations of a control unit of the heat energy recovery device.

In the second embodiment, a liquid level sensor 15 for detecting the height of a liquid level of the accumulation layer in the second heater 3 is provided. As the liquid level sensor 15, for example, a float switch is used. Below, a method of leading out the oil from the second heater 3 to the oil separation unit 12 in a situation where the accumulation layer is formed in the second heater 3 during the operation of the heat energy recovery device 1 will be described with reference to FIG. 4. First, the control unit 16 determines whether or not the height of the in-separation unit liquid level of the oil separation unit 12 falls below the lower limit value (step S41). When it is determined that the height of the in-separation unit liquid level is the lower limit value or more (determined as NO), the step S41 is repeated.

When it is determined that the height of the in-separation unit liquid level is less than the lower limit value (determined as YES), then the control unit 16 performs the speed reduction control over the working medium pump 7. This operation reduces the amount of the working medium in a liquid-phase flowing into the second heater 3 (step S42). Following the step S42, the height of the liquid level of the accumulation layer in the second heater 3 (i.e. a liquid level of the oil, hereinafter referred to as an "in-heater liquid level") is detected by the liquid level sensor 15, and the control unit 16 determines whether or not a predetermined value is reached (step S43). When it is determined that the height of the in-heater liquid level does not reach the predetermined value (determined as NO), the rotational speed of the working medium pump 7 is adjusted, so that the inflow rate of the working medium is adjusted (step S42). When it is determined that the height of the in-heater liquid level reaches the predetermined value (determined as YES), the control unit 16 performs the opening control for opening the on-off valve 11 (step S44).

When the on-off valve 11 is opened in the step S44, the control unit 16 determines whether or not the height of the in-separation unit liquid level reaches the lower limit value or more (step S45). When it is determined that the height of the in-separation unit liquid level is less than the lower limit value (determined as NO), the on-off valve 11 is kept open for the predetermined period of time. Then the height of the in-separation unit liquid level is detected again and when it is determined that the height of the in-separation unit liquid level reaches the lower limit value or more (determined as YES), the control unit 16 closes the on-off valve 11 (step S46). Further the rotational speed of the working medium pump 7 is restored to the original rotational speed before the speed reduction control, and the inflow rate of the working medium into the second heater 3 is restored to the original setting (step S47).

During the operation of the heat energy recovery device 1A, when the storage amount of the oil in the oil separation unit 12 is decreased again, the above-mentioned steps S42-S47 are repeated. The same operations are applied in the third to fifth embodiments described below.

In the second embodiment, when the accumulation layer is formed in the second heater 3, the speed reduction control of the working medium pump 7 is performed based on the detection results of the liquid level sensor 13 to reduce the inflow rate of the working medium into the second heater 3, and also the on-off valve 11 in the oil-leading passage 10 is opened. These operations make it possible to lead out substantially only the oil L1 from the second heater 3, and properly operate the heat energy recovery device 1A under an environment in which the heat input quantity of the heat medium and the circulation rate of the working medium fluctuate.

By providing the liquid level sensor 15 in the second heater 3, it is made possible to more accurately grasp the height of the in-heater liquid level of the accumulation layer and more surely prevent the leakage of the working medium to the oil separation unit 12.

(Third Embodiment)

Figure 5:
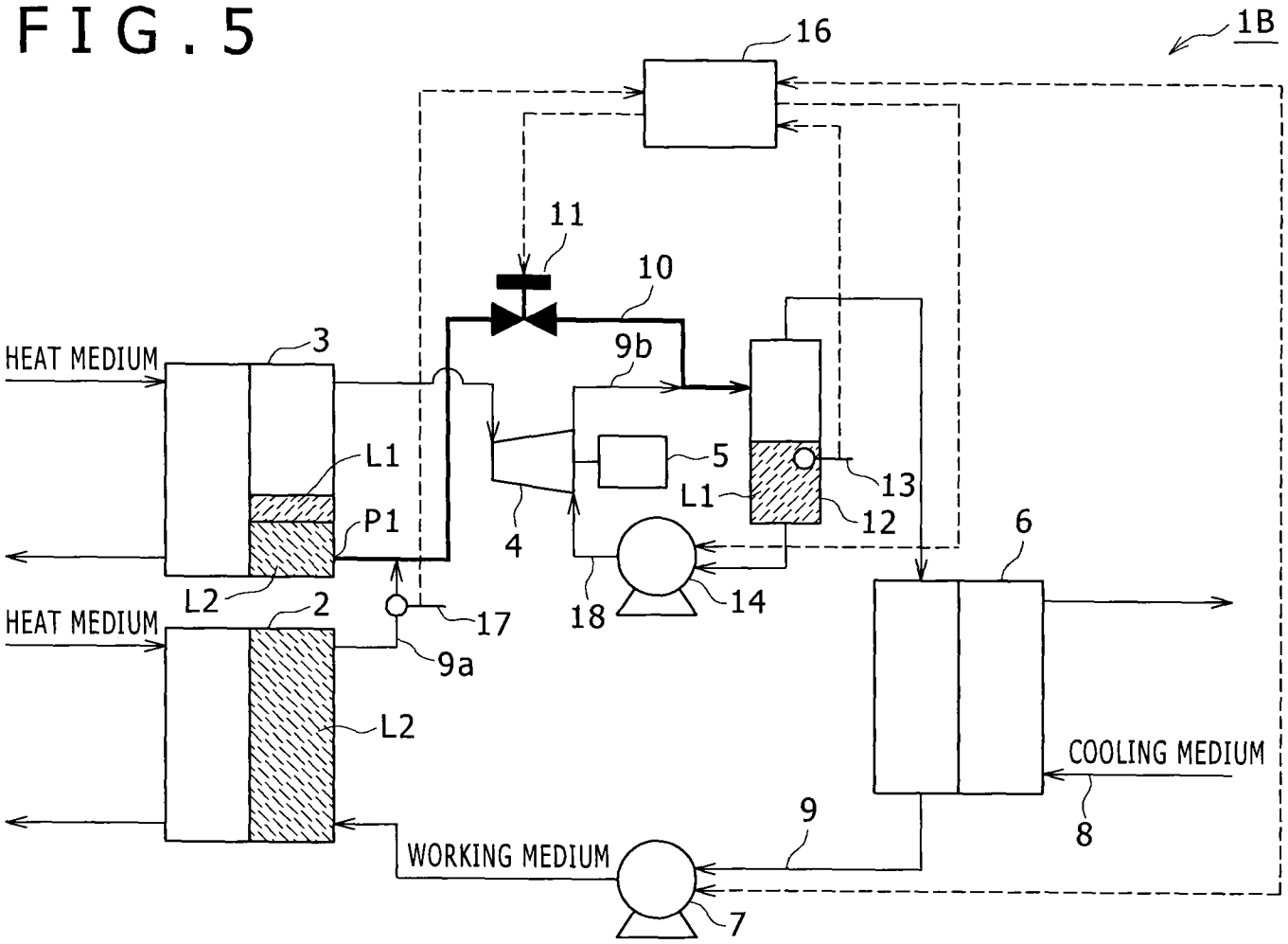
FIG. 5 is a configuration diagram showing a heat energy recovery device according to a third embodiment of the present invention.

Next, another operational example of a heat energy recovery device 1B in a situation where the accumulation layer is formed in the second heat 3 will be described as a third embodiment. FIG. 5 is a configuration diagram showing the heat energy recovery device 1B. In the heat energy recovery device 1B, a liquid level sensor 17 is provided in the heater connection pipe 9*a*. Other structures are the same as in the first embodiment. As described above, the oil-leading passage 10 is connected to the heater connection pipe 9*a*.

Figure 6:
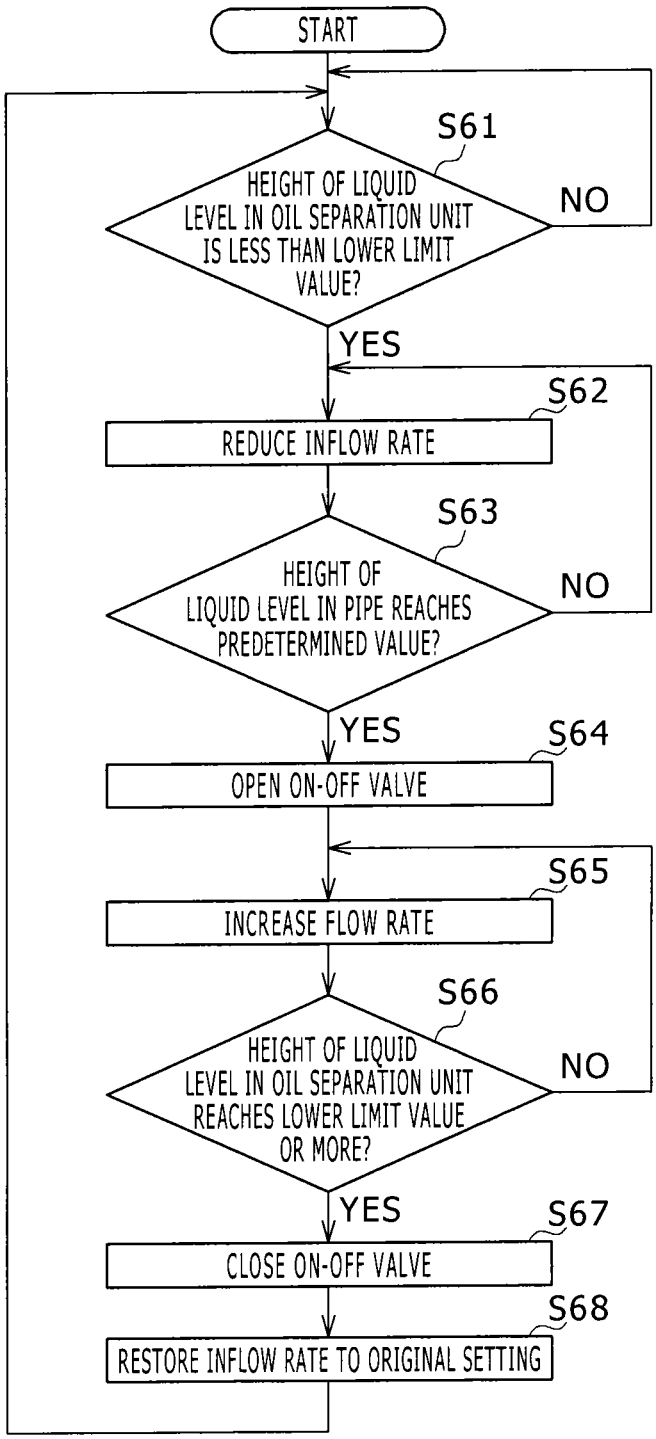
FIG. 6 is a flowchart showing operations of a control unit of the heat energy recovery device.

In steps by which the oil is led out during the operation of the heat energy recovery device 1B, as shown in FIG. 6, it is first determined whether or not the height of the in-separation unit liquid level of the oil separation unit 12 falls below the lower limit value (step S61), and when it is determined that the height of the in-separation unit liquid level is less than the lower limit value (determined as YES), the control unit 16 performs the speed reduction control over the working medium pump 7 to reduce the inflow rate of the working medium into the second heater 3 (step S62). This operation eliminates the accumulation layer from the second heater 3 and moves the oil L1 to the heater connection pipe 9*a*.

The control unit 16 determines whether or not a position of a liquid level of oil in the heater connection pipe 9*a* (hereinafter refereed to as a "in-connection pipe liquid level") reaches a predetermined position based on detection results of the liquid level sensor 17 (step S63), and when it is determined that the position of the in-connection pipe liquid level reaches the predetermined position, the on-off valve 11 is opened (step S64).

Next, the control unit 16 performs a control to slightly increase the rotational speed of the working medium pump 7, thereby increasing the flow rate of the working medium (step S65). However, the increased rotational speed of the working medium pump 7 is still lower than the original speed before the speed reduction control. When the flow rate of the working medium is slightly increased, the oil L1 in the heater connection pipe 9*a* is pushed away to the downstream side and led out to the oil separation unit 12 through the oil-leading passage 10. Since the pressure inside of the second heater 3 is higher than that inside of the oil separation unit 12, the oil L1 hardly flows into the second heater 3.

The control unit 16 determines whether or not the height of the in-separation unit liquid level reaches the lower limit value or more (step S66). When the height of the in-separation unit liquid level is less than the lower limit value, the rotational speed of the working medium pump 7 is further increased and the height of the in-separation unit liquid level is again detected. In this manner, the rotational speed of the working medium pump 7 is gradually increased within a range below the original rotational speed before the speed reduction control until the height of the in-separation unit liquid level reaches the lower limit value or more in the heat energy recovery device 1B. When it is determined that the height of the in-separation unit liquid level reaches the lower limit value or more, the control unit 16 performs the control for closing the on-off valve 11 (step S67). The control unit 16 restores the rotational speed of the working medium pump 7 to the original rotational speed before the speed reduction control, thus the inflow rate of the working medium into the second heater 3 is restored to the original setting (step S68).

In the third embodiment, the oil in the second heater 3 is first moved to the heater connection pipe 9*a* by the speed reduction control of the working medium pump 7, then, while the control for opening the on-off valve 11 is performed, the control for increasing the rotational speed of the working medium pump 7, i.e. a control for increasing the flow rate of the working medium, is performed. The operations make it possible to lead out only the oil in the second heater 3 to the oil separation unit 12. In the heat energy recovery device 1B, by providing the liquid level sensor 17 in the heater connection pipe 9*a*, the oil can be properly led out to the oil separation unit 12 through the oil-leading passage 10 even if the second heater 3 has a structure by which a detector is difficult to be installed. In the heat energy recovery device 1B, the control for increasing the rotational speed of the working medium pump 7 may be performed before or at the same time of the control for opening the on-off valve 11.

(Fourth Embodiment)

Figure 7:
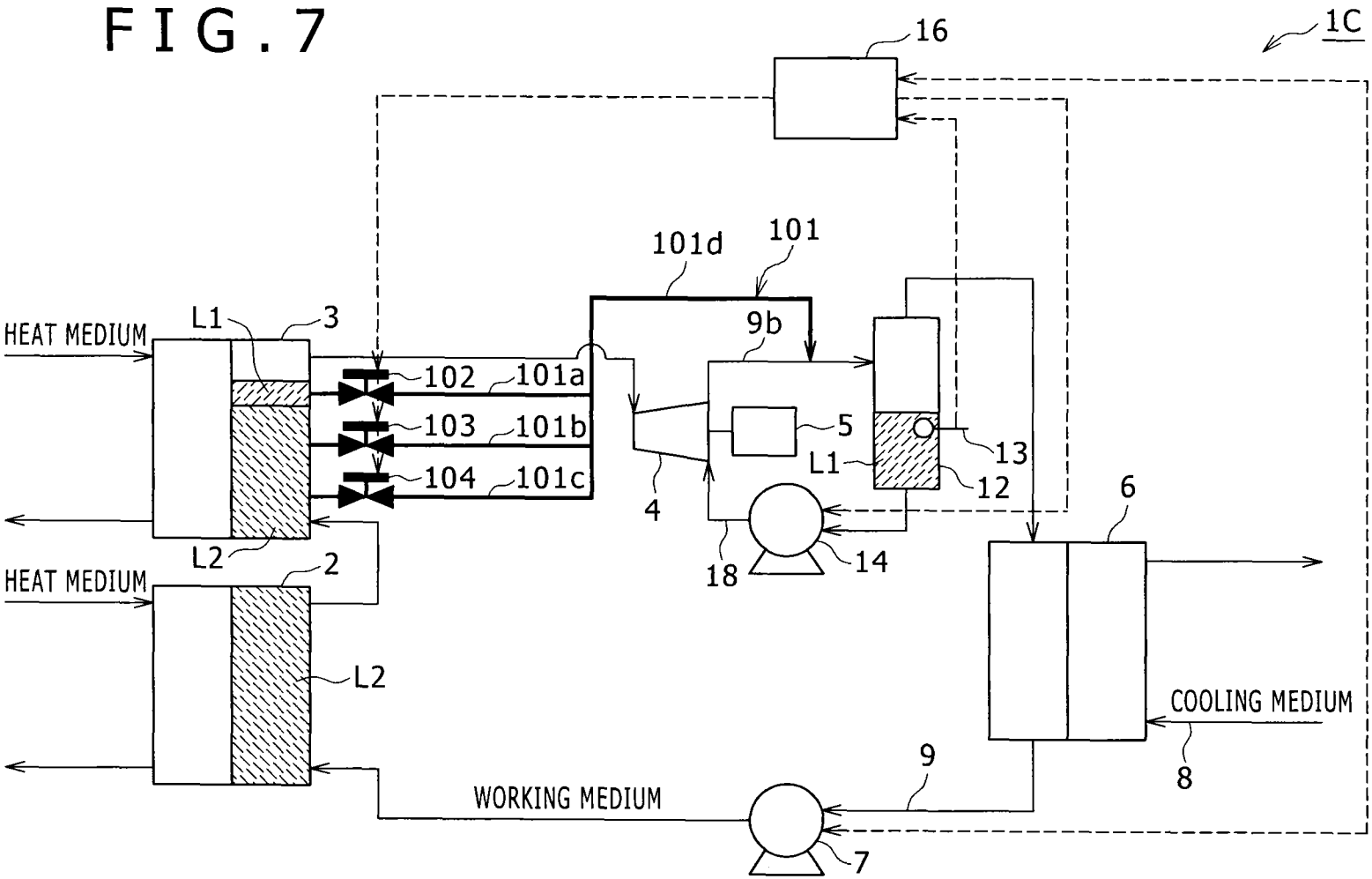
FIG. 7 is a configuration diagram showing a heat energy recovery device according to a fourth embodiment of the present invention.

FIG. 7 is a configuration diagram showing a heat energy recovery device 1C according to a fourth embodiment of the present invention. Only constitution elements different from the first embodiment will be described here and the description of other constitution elements is omitted.

An oil-leading passage 101 comprises a first channel 101*a*, a second channel 101*b*, and a third channel 101*c*. The first channel 101*a*, the second channel 101*b*, and the third channel 101*c* are connected to the second heater 3 at different height positions from one another. The connection position of the first channel 101*a* to the second heater 3 is higher than that of the second channel 101*b*. The connection position of the second channel 101*b* to the second heater 3 is higher than that of the third channel 101*c*. The first to third channels 101*a*-101*c* are connected to one confluent channel 101*d*, and a connection end part of the confluent channel 101*d* is connected to the pipe 9*b*, through which the working medium is led from the expander 4 to the oil separation unit 12 in the circulation flow passage 9. The connection end part of the confluent channel 101*d* may be directly connected to the oil separation unit 12.

The first channel 101*a*, the second channel 101*b*, and the third channel 101*c* are respectively provided with on-off valves 102, 103, and 104, which are solenoid valves. Opening and closing of the on-off valves 102, 103, and 104 is controlled by the control unit 16.

Figure 8:
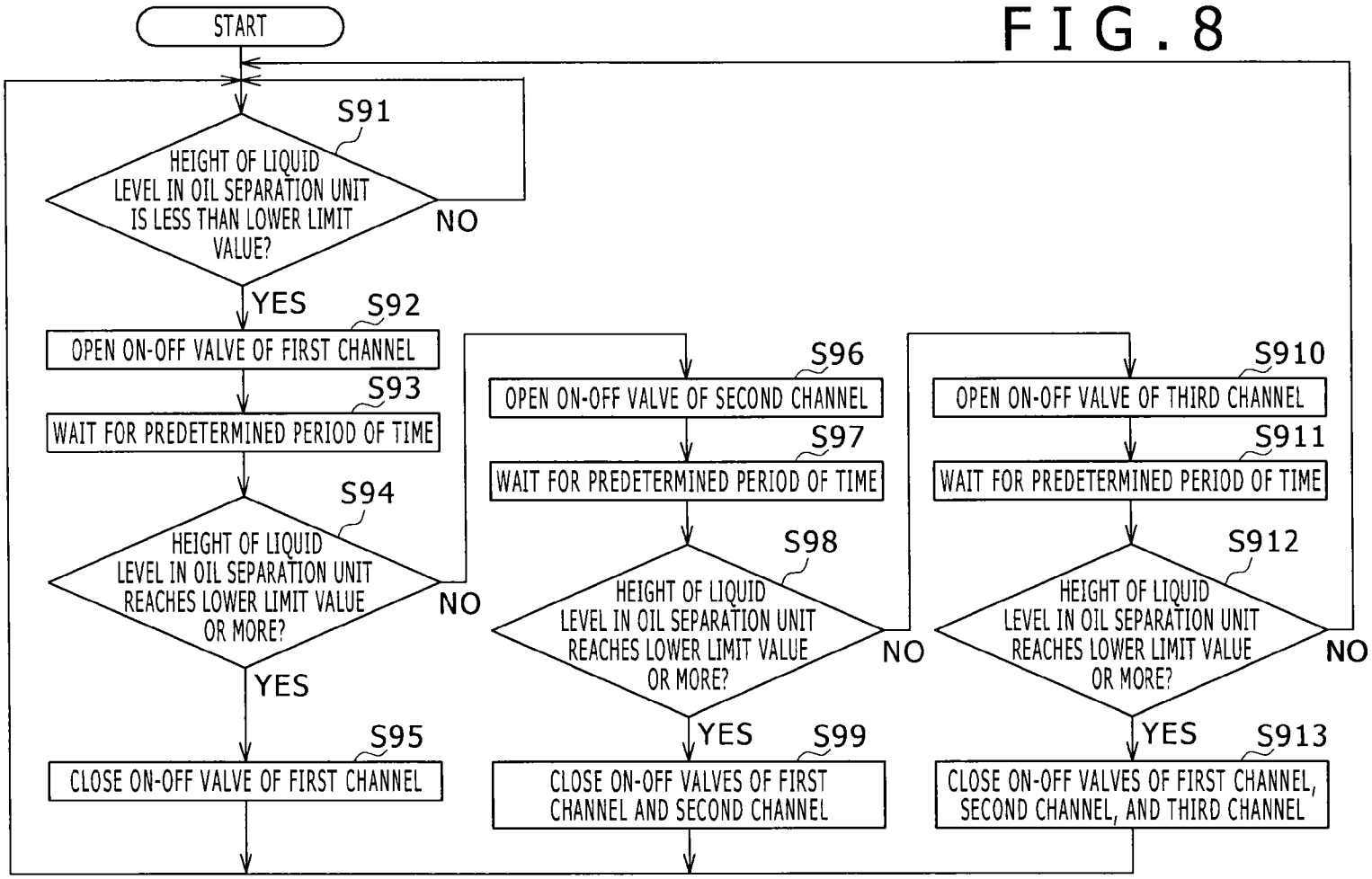
FIG. 8 is a flowchart showing operations of a control unit of the heat energy recovery device.

Next, operations of the heat energy recovery device 1C in a situation where the accumulation layer is formed in the second heater 3 will be described with reference to FIG. 8. The control unit 16 first determines whether or not the height of the in-separation unit liquid level falls below the lower limit value (step S91). When it is determined that the height of the in-separation unit liquid level is the lower limit value or more (determined as NO), the step S91 is repeated. On the other hand, when it is determined that the height of the in-separation unit liquid level is less than the lower limit value (determined as YES), then the control unit 16 performs a control for opening the on-off valve 102 disposed in the first channel 101*a* (step S92).

Following the step S92, the on-off valve 102 is kept open for a predetermined period of time (step S93). Then the control unit 16 determines whether or not the height of the in-separation unit liquid level reaches the lower limit value or more (step S94). When it is determined that the height of the in-separation unit liquid level reaches the lower limit value or more (determined as YES), the control unit 16 performs a control for closing the on-off valve 102 (step S95).

When it is determined that the height of the in-separation unit liquid level is less than the lower limit value (determined as NO), the control unit 16 performs a control for opening the on-off valve 103 disposed in the second channel 101*b* (step S96). Following the step S96, the on-off valve 103 is kept open for the predetermined period of time (step S97). Then it is determined whether or not the height of the in-separation unit liquid level reaches the lower limit value or more (step S98). When it is determined that the height of the in-separation unit liquid level reaches the lower limit value or more (determined as YES), the control unit 16 performs a control for closing the on-off valve 102 and the on-off valve 103 (step S99).

When it is determined that the height of the in-separation unit liquid level is less than the lower limit value (determined as NO), the control unit 16 performs a control for opening the on-off valve 104 disposed in the third channel 101*c* (step S910). As in steps S93 and S94, and steps S97 and S98, the on-off valve 104 is kept open for the predetermined period of time (step S911), and then it is determined whether or not the height of the in-separation unit liquid level reaches the lower limit value or more (step S912). When it is determined that the height of the in-separation unit liquid level reaches the lower limit value or more (determined as YES), the control unit 16 performs a control for closing the on-off valve 102, the on-off valve 103, and the on-off valve 104 (step S913). On the other hand, when it is determined that the height of the liquid level is less than the lower limit value (determined as NO), the step S91 is repeated.

In the fourth embodiment, the on-off valves are sequentially opened from the one disposed in the channel having the highest connection position to the second heater 3 among the first to third channels 101*a*-101*c* until the amount of the oil in the oil separation unit 12 reaches the predetermined value or more. In this manner, the oil in the second heater 3 can be easily led out to the oil separation unit 12 without performing the rotational speed control of the working medium pump 7.

(Fifth Embodiment)

Figure 9:
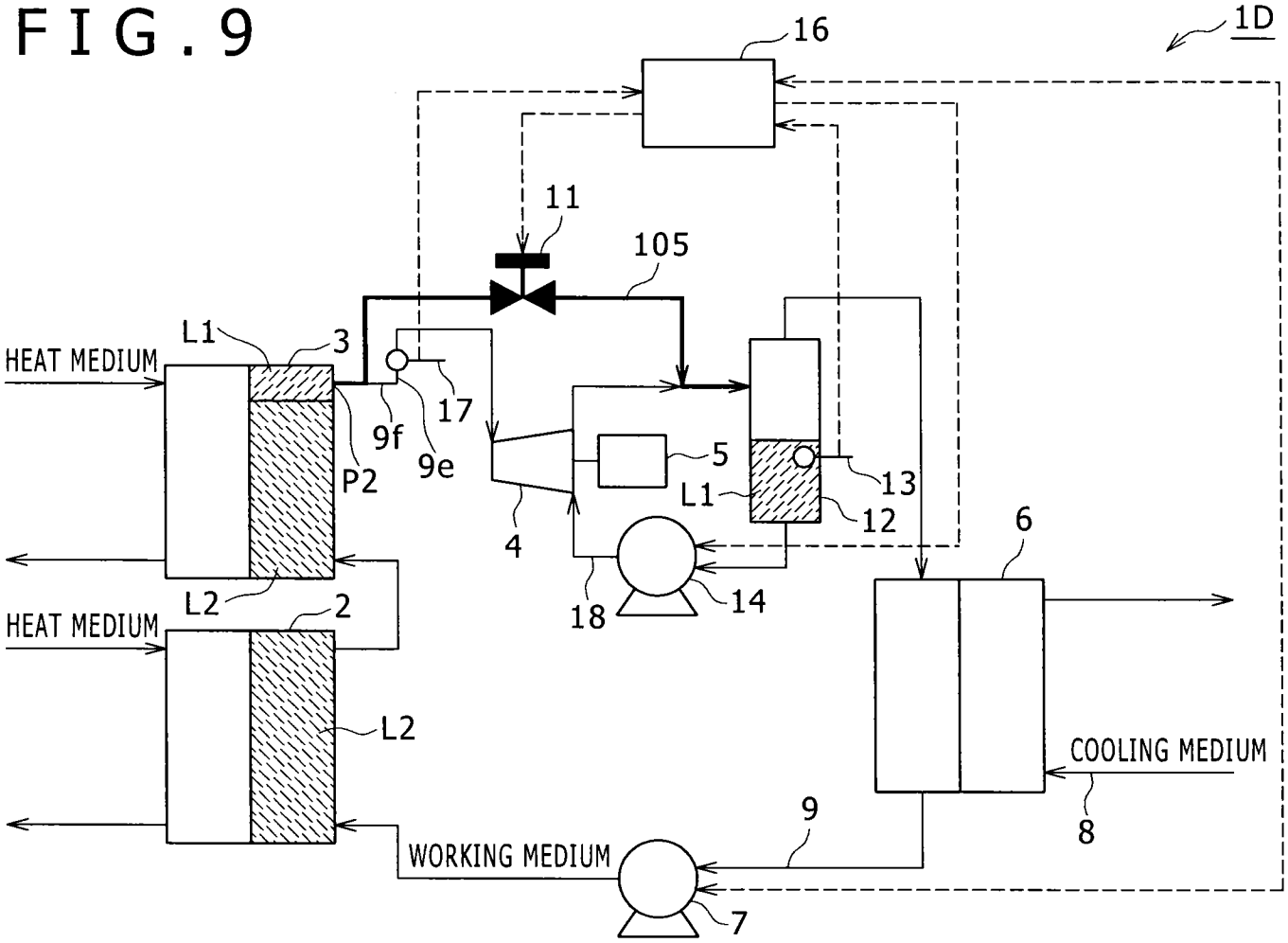
FIG. 9 is a configuration diagram showing a heat energy recovery device according to a fifth embodiment of the present invention.

FIG. 9 is a configuration diagram showing a heat energy recovery device 1D according to a fifth embodiment of the present invention. Only constitution elements different from the first embodiment will be described here and the description of other constitution elements is omitted.

An oil-leading passage 105 in the fifth embodiment is connected to a part of the circulation flow passage 9, connecting the expander 4 and the oil separation unit 12, and a part of the circulation flow passage 9, connecting the second heater 3 and the expander 4 (hereinafter referred to as a "medium-leading passage 9*f*"). An upstream end P2 of the medium-leading passage 9*f* is connected to an upper part, i.e. the downstream side of the second heater 3. The medium-leading passage 9*f* includes a liquid level sensor 17.

Figure 10:
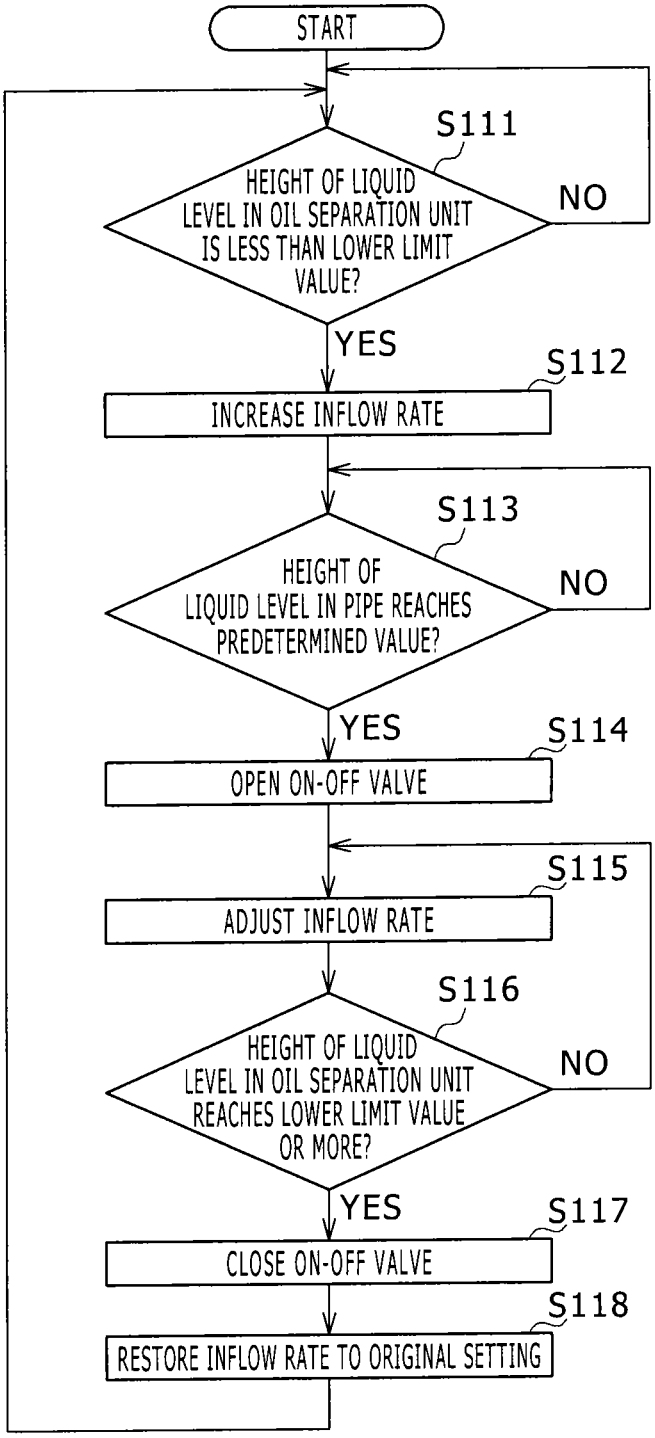
FIG. 10 is a flowchart showing operations of a control unit of the heat energy recovery device.

FIG. 10 is a diagram showing a sequence of steps by which oil is led out from the second heater 3. When the accumulation layer is formed in the second heater 3, it is first determined whether or not the height of the in-separation unit liquid level falls below the lower limit value (step S111). When it is determined that the height of the in-separation unit liquid level is less than the lower limit value (determined as YES), a control for increasing the rotational speed of the working medium pump 7 (hereinafter referred to as a "speed-increasing control") is performed to increase the inflow rate of the working medium in a liquid-phase into the second heater 3 (step S112). The interior of the second heater 3 is filled with the working medium in a liquid-phase, thus the oil is overflown from the second heater 3 to the medium-leading passage 9*f*. Then it is determined whether or not the height of a liquid level of the oil in the medium-leading passage 9*f* reaches a predetermined value (step S113). When it is determined that the height of the liquid level is less than the predetermined value (determined as NO), the step S113 is repeated after the lapse of a predetermined period of time. When it is determined that the predetermined value is reached (determined as YES), the on-off valve 11 is opened (step S114), and also the rotational speed of the working medium pump 7 is adjusted to increase (step S115), so that the oil L1 is led out to the oil separation unit 12 through the oil-leading passage 105. Further, at a time of opening the on-off valve 11, a blocking valve disposed in the medium-leading passage 9*f*, not illustrated may be simultaneously closed to shut off an inflow of the working medium into the expander 4.

It is determined whether or not the height of the in-separation unit liquid level reaches the lower limit value or more (step S116), and when it is determined that the height of the in-separation unit liquid level is less than the lower limit value, the working medium pump 7 is kept at high rotational speed and the height of the in-separation unit liquid level is repeatedly detected. When it is determined that the height of the in-separation unit liquid level reaches the lower limit value or more (determined as YES), the on-off valve 11 is closed (step S117). The control unit 16 performs a control for restoring the rotational speed of the working medium pump 7 to the original rotational speed before the speed-increasing control, and the flow rate of the working medium is restored to the original setting (step S118).

In the heat energy recovery device 1D, when the accumulation layer is formed in the second heater 3, the speed-increasing control of the working medium pump 7 based on detection results of the liquid level sensors 13 and 17, i.e. a control for increasing the flow rate of the working medium heading to the second heater 3, and the control for opening the on-off valve 11 in the oil-leading passage 105 are performed. The amount of the accumulation layer in the second heater 3 is intentionally increased, so that only the oil present on the top of the accumulation layer can be led out to the oil separation unit 12 through the oil-leading passage 10. In the fifth embodiment, even when the second heater 3 does not contain any working medium in a liquid-phase, i.e. in a case where the second heater 3 functions as the super heater, the oil L1 can be still discharged to the oil separation unit 12 by increasing the inflow rate of the working medium and filling the interior of the second heater 3 with the working medium in a liquid-phase. In the operation of the heat energy recovery device 1D, the step S115 is not necessarily performed.

(Another Embodiment)

The embodiments of the present invention have been described above, however the present invention is not limited to the embodiments described above, and a variety of alterations can be executed.

Figure 11:
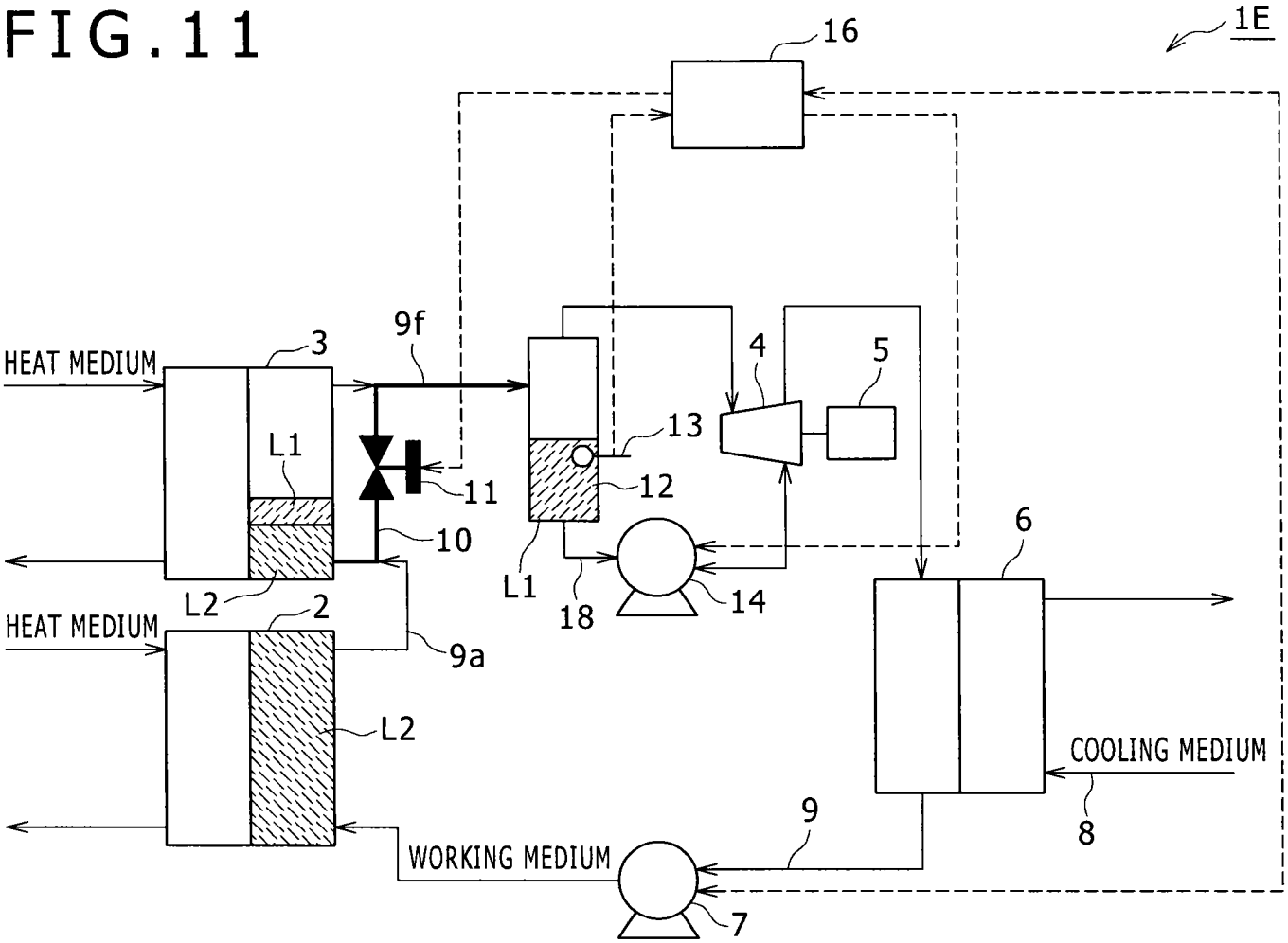
FIG. 11 is a configuration diagram showing a heat energy recovery device according to another first embodiment of the present invention.

FIG. 11 is a diagram showing a heat energy recovery device 1E according to another embodiment of the present invention. The oil separation unit 12 may be provided between the second heater 3 and the expander 4 in the circulation flow passage 9. The oil-leading passage 10 connects the heater connection pipe 9*a* and the medium-leading passage 9*f* in the circulation flow passage 9. In the embodiment shown in FIG. 11, as in the case of the first embodiment, the speed reduction control of the working medium pump 7 is performed to reduce the accumulation layer in the second heater 3, thus the oil L1 is led out from the second heater 3 through the oil-leading passage 10.

Figure 12:
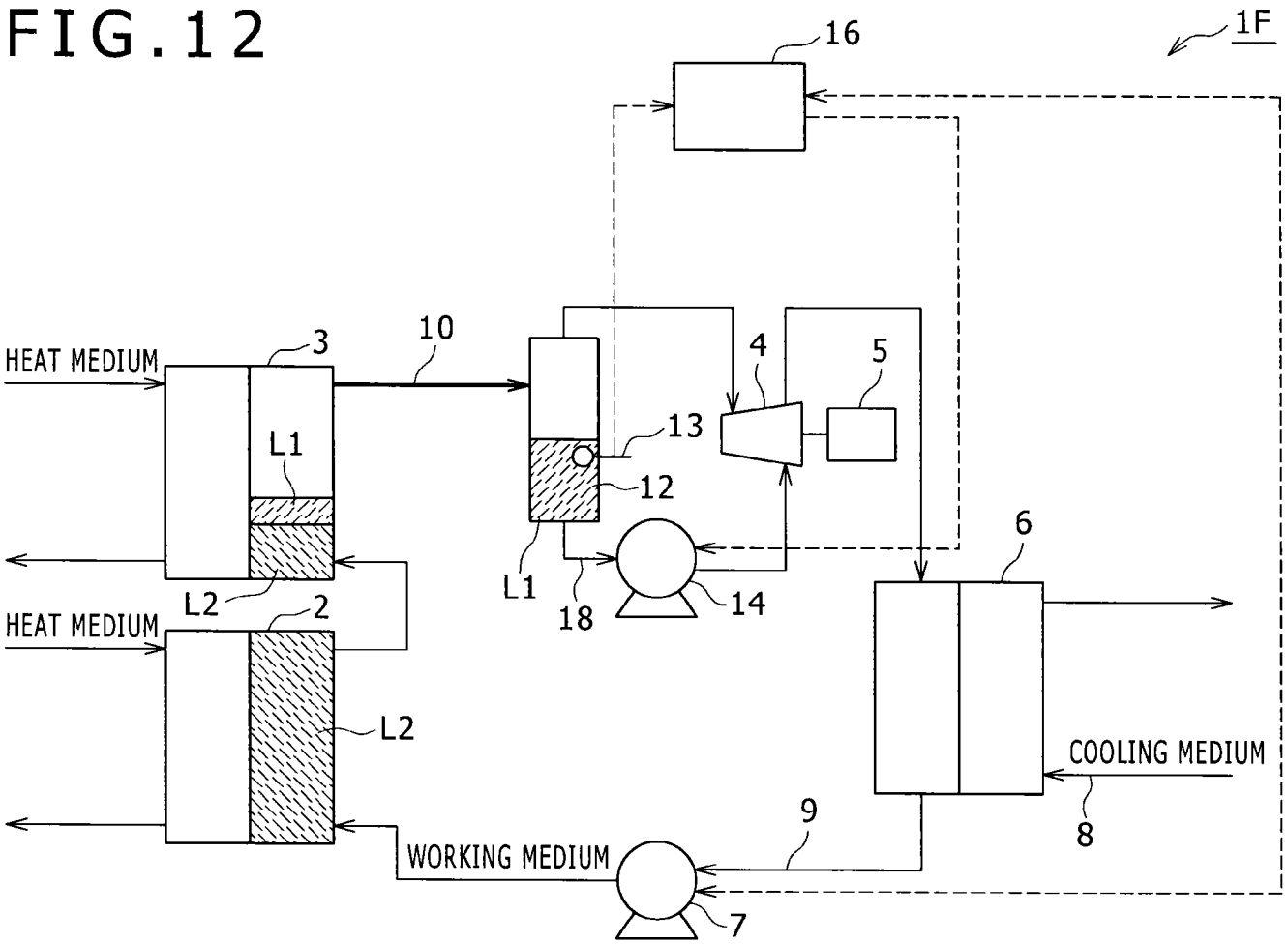
FIG. 12 is a configuration diagram showing a heat energy recovery device according to another second embodiment of the present invention.

As shown in FIG. 12, the medium-leading passage 9*f* may be used as the oil-leading passage 10. In this case, as in the case of the fifth embodiment, the interior of the second heater 3 is filled with the working medium in a liquid-phase by the speed-increasing control of the working medium pump 7, thus the oil L1 is led out from the second heater 3 to the oil separation unit 12 through the oil-leading passage 10.

In the fifth embodiment described above, the amount of the working medium in a liquid-phase in the second heater 3 may be increased by reducing a flow rate and the temperature of the heat medium circulating in the second heater 3. That is, the apparent inflow rate of the working medium into the second heater 3 may be increased without changing the total amount of the working medium. When the height of the in-separation unit liquid level reaches the lower limit value or more, the flow rate and the temperature of the heat medium are restored to the original settings. The same operations are applied to the device having the structure shown in FIG. 12.

In the first embodiment described above, the method of leading out the oil from the second heater 3 as described above may be applied when the second heater 3 does not contain any working medium, i.e. in a case where the second heater 3 functions as the super heater. The speed reduction control of the working medium pump 7 is performed to reduce the inflow rate of the working medium into the second heater 3 (step S2: see FIG. 2), thereby decreasing the amount of the oil flowing from the first heater 2 to the second heater 3 along with the working medium in a vapor-phase. After the lapse of the fixed period of time (step S3), the opening of the on-off valve 11 in the oil-leading passage 10 can lead out the oil to the oil separation unit 12. Further, the method of leading out the oil from the second heater 3 according to the other embodiment may be applied to the case where the second heater 3 functions as the super heater.

In the first to third embodiments described above, the oil-leading passage 10 may be directly connected to the upstream side of the second heater 3. Similarly, in the fifth embodiment, the oil-leading passage 105 may be directly connected to the downstream side of the second heater 3.

In the first to third embodiments, the speed reduction control of the working medium pump 7 is performed as a means of the flow rate reduction control for reducing the flow rate of the working medium heading to the second heater 3, however, instead of or in combination with the speed reduction control, a flow rate adjustment valve may be provided on the downstream side of the working medium pump 7 to perform a control for reducing the opening of the flow rate adjustment valve. Similarly, in the fifth embodiment, in addition to the speed-increasing control of the working medium pump 7 as a means of the flow rate-increasing control for increasing the flow rate of the working medium heading to the second heater 3, a control for increasing the opening of the flow rate adjustment valve may be performed. The same operation may be applied for increasing the flow rate of the working medium in the third embodiment.

In the second embodiment, where the second heater 3 is arranged below the first heater 2 in the gravity direction, the liquid level of the oil or the working medium in a liquid-phase is formed in the heater connection pipe 9*a* to have the same height as that of the in-heater liquid level, thus the liquid level sensor 15 may be provided in the heater connection pipe 9*a* to perform various controls based on detection results of the liquid level sensor 15.

In the embodiments described above, instead of using the detection results of the liquid level sensor 13 in the oil separation unit 12, for example, an operation of leading out the oil from the second heater 3 may be performed based on an output of a power generator 5. Further this operation may be performed based on the temperature of the working medium before flowing into the second heater 3, the temperature of the working medium after flowing out of the second heater 3, and the flow rate of the working medium. The flow rate of the working medium can be estimated based on a frequency of the working medium pump 7.

In the fourth embodiment described above, in addition to the first to third channels 101*a*-101*c*, the oil-leading passage 101 may be provided with a channel connected to the heater connection pipe 9*a*, similar to the one shown in FIG. 5. In this manner, it becomes possible to lead out the oil to the oil separation unit 12 even if the oil is accumulated in the heater connection pipe 9*a*.

In the embodiments described above, as the first heater 2 and the second heater 3, other heat exchangers, such as a plate-type heat exchanger may be used.

What is claimed is:

1. A heat energy recovery device that includes a working medium and oil having a smaller specific gravity than the working medium, coexisting with the working medium, and utilizes a Rankine cycle of the working medium, the heat energy recovery device comprising:

a first heater to heat the working medium by heat exchange with a first heating medium;

a second heater to further heat the working medium flowing out of the first heater by heat exchange with a second heating medium;

an expander driven by the working medium flowing out of the second heater;

a generator connected to the expander;

a condenser to condense the working medium flowing out of the expander;

a working medium pump to send the working medium condensed in the condenser to the first heater;

an oil separation mechanism to separate oil from the working medium;

an oil-leading passage to lead oil in the second heater to the oil separation mechanism, connected to an upstream side of the second beater or a heater connection pipe connecting the second heater and the first heater, through which the working medium flows;

an on-off mechanism disposed in the oil-leading passage; and a controller to control an inflow rate of the working medium into the second heater and opening-closing of the on-off mechanism, wherein, when a liquid level of the oil in the oil separation mechanism is less than a predetermined lower limit value, the controller performs a flow rate reduction control to reduce a flow rate of the working medium heading to the second heater, and an opening control to open the on-off mechanism subsequent to the flow rate reduction control, thereby leading out oil accumulated in the second heater to the oil separation mechanism through the oil-leading passage.

2. The heat energy recovery device according to claim 1, wherein the flow rate reduction control and the opening control are performed when the working medium in a liquid-phase and oil form an accumulation layer in the second heater.

3. The heat energy recovery device according to claim 1, wherein the flow rate reduction control is a control to reduce a rotational speed of the working medium pump.

4. The heat energy recovery device according to claim 1, wherein the controller waits for a fixed period of time after performing the flow rate reduction control, and then performs the opening control.

5. The heat energy recovery device according to claim 1, further comprising a liquid level sensor to detect a height of a liquid level of oil or a height of a liquid level of its equivalent in the second heater, wherein the controller performs the flow rate reduction control, and then performs the opening control when the height of the liquid level of the oil or the height of the liquid level of its equivalent reaches a predetermined value.

6. The heat energy recovery device according to claim 1, wherein the oil-leading passage is connected to the heater connection pipe, and after performing the flow rate reduction control to move oil in the second heater to the heater connection pipe, the controller performs a control to increase a flow rate of the working medium together with the opening control.

7. A heat energy recovery device that includes a working medium and oil having a smaller specific gravity than the working medium, coexisting with the working medium, and utilizes a Rankine cycle of the working medium, the heat energy recovery device comprising:

a first heater to heat the working medium by heat exchange with a first heating medium;

a second heater to further heat the working medium flowing out of the first heater by heat exchange with a second heating medium;

an expander driven by the working medium flowing out of the second heater;

a generator connected to the expander;

a condenser to condense the working medium flowing out of the expander;

an oil separation mechanism to separate oil from the working medium;

an oil-leading passage comprising a plurality of channels having different heights from one another, which are connected to the second heater;

a plurality of on-off mechanisms disposed in the plurality of channels; and a controller to control opening-closing of each of the plurality of on-off mechanisms, wherein the controller sequentially opens the on-off mechanisms disposed in the plurality of channels in order from the one disposed in the channel having the highest connection position to the second heater, thereby leading out oil to the oil separation mechanism through the oil-leading passage.

8. The heat energy recovery device according to claim 7, wherein the controller sequentially opens the on-off mechanisms disposed in the plurality of channels in order from the one disposed in the channel having the highest connection position to the second heater when the working medium in a liquid-phase and oil form an accumulation layer in the second heater.

9. A heat energy recovery device that includes a working medium and oil having a smaller specific gravity than the working medium, coexisting with the working medium, and utilizes a Rankine cycle of the working medium, the heat energy recovery device comprising:

a first heater to heat the working medium by heat exchange with a first heating medium;

a second heater to further heat the working medium flowing out of the first heater by heat exchange with a second heating medium;

an expander driven by the working medium flowing out of the second heater;

a generator connected to the expander;

a condenser to condense the working medium flowing out of the expander;

a working medium pump to send the working medium condensed in the condenser to the first heater;

an oil separation mechanism to separate oil from the working medium;

an oil-leading passage to lead oil in the second heater to the oil separation unit, connected to the downstream side of the second heater, a channel connecting the second heater and the expander including a sensor;

an on-off mechanism disposed in the oil-leading passage; and a controller to control an inflow rate of the working medium into the second heater and opening-closing of the on-off mechanism, wherein, when a liquid level of the oil in the oil separation mechanism is less than a predetermined lower limit value, the controller performs a flow rate-increasing control to increase a flow rate of the working medium heading to the second heater, and an opening control to open the on-off mechanism when the sensor indicates that the liquid level of oil in the channel reached a predetermined value, thereby leading out oil to the oil separation mechanism through the oil-leading passage.

10. The heat energy recovery device according to claim 9, wherein the flow rate-increasing control and the opening control are performed when the working medium in a liquid-phase and oil form an accumulation layer in the second heater.

11. The heat energy recovery device according to claim 9, wherein the flow rate-increasing control is a control to increase a rotational speed of the working medium pump.

* * * * *